United States Patent [19]

Ogawa et al.

[11] 4,124,391

[45] Nov. 7, 1978

[54] PROCESS FOR PROCESSING COLOR PHOTOGRAPHIC MATERIAL

[75] Inventors: Junkiti Ogawa; Isao Shimamura, both of Minami Ashigara, Japan

[73] Assignee: Fuji Photo Film Co., Ltd., Minami Ashigara, Japan

[21] Appl. No.: 768,817

[22] Filed: Feb. 15, 1977

[30] Foreign Application Priority Data

Feb. 24, 1976 [JP] Japan ..... 51-19216

[51] Int. Cl.[2] ..... G03C 5/30; G03C 7/00

[52] U.S. Cl. ..... 96/66.5; 96/56

[58] Field of Search ..... 96/66, 66.3, 66.4, 66.5, 96/22, 55, 56

[56] References Cited

U.S. PATENT DOCUMENTS

| | | | |
|---|---|---|---|
| 318,113 | 5/1943 | Diamant-Eerde | 96/61 M |
| 1,973,466 | 9/1934 | Crabtree | 96/66.3 |
| 2,138,486 | 11/1938 | Fournes et al. | 96/66.3 |
| 2,164,687 | 7/1939 | Nassau | 96/66.3 |
| 3,095,302 | 6/1963 | Jeffreys | 96/22 |
| 3,146,102 | 8/1964 | Weyerts et al. | 96/56 |
| 3,212,893 | 10/1965 | Salminen | 96/56 |
| 3,658,527 | 4/1972 | Kunz | 96/66.4 |
| 3,746,564 | 7/1973 | Parsons | 96/66 R |

OTHER PUBLICATIONS

Photographic Absts. 1952, p. 206, 1034P, 96–66.4.

*Primary Examiner*—Mary F. Kelley

*Attorney, Agent, or Firm*—Sughrue, Rothwell, Mion, Zinn and Macpeak

[57] ABSTRACT

A process for processing color photographic materials, which involves color development processing an image wise exposed silver halide color light-sensitive material with a color developer, in which the color developer contains an aromatic primary amine developing agent and at least one monosaccharide selected from the group consisting of a pentose, a methylpentose and a hexose.

7 Claims, No Drawings

PROCESS FOR PROCESSING COLOR PHOTOGRAPHIC MATERIAL

BACKGROUND OF THE INVENTION

1. Field of the Invention

The present invention relates to a process for processing color photographic materials. More particularly, it relates to a process for processing color photographic materials using a color developer containing a novel antioxidant harmless to the human body in place of hydroxylamine.

2. Description of the Prior Art

Photographic processing steps for obtaining color photographic images from silver halide color photographic light-sensitive materials comprise at least two fundamental steps, that is, a color-developing step and a silver-removing step. In the color-developing step wherein color images are formed through a coupling reaction between an oxidation product of a developing agent produced upon reduction of silver halide and a dye-forming coupler, a color developer containing an aromatic primary amine developing agent is usually used. In order to prevent a reduction in developing power resulting from air oxidation with the lapse of time, the color developer usually contains a sulfite and hydroxylamine as antioxidants.

In color development, fog called "color fog" or "stain" is often formed. This phenomenon cannot be prevented with an ordinarily employed, so-called anti-fogging agent such as an alkali metal halide, 1-phenyl-5-mercaptotetrazole, benzotriazole, 5-nitrobenzimidazole, etc. "Color fog" is considered to be caused by an oxidation product formed as a result of a color developing agent being partly oxidized, i.e., semiquinone or quinoneimine derived from an aromatic primary amine, quinonemonoimine formed via a deamination reaction, quinonemonoimine sulfite adduct, etc. Such color fog causes a reduction in color purity in multilayer color light-sensitive materials as well as formation of color stain in the non-image areas. Color fog increases when the color developer is exhausted with the lapse of time or by repeated use.

Hydroxylamine plays an important role with respect to prevention of color fog. Color fog seriously increases when no hydroxylamine is present or when the hydroxylamine has been decomposed. Therefore, hydroxylamine has so far been an indispensable ingredient in a color developer. However, hydroxylamine has the defect that, when heavy metal ion such as iron or copper ion is also present in the developer, the decomposition of hydroxylamine is markedly accelerated. Contamination of the developer with iron ion or copper ion results from various ion sources such as water, vessels and the apparatus used for preparing the developer. The vessel for storing the developer, and pumps, troughs and the apparatus used for development. When decomposed, hydroxylamine loses its antioxidizing action and, in addition, the decomposition products thereof further increase fog. Attempts have been made to add aminopolycarboxylic acids such as ethylenediaminetetraacetic acid, nitrilotriacetic acid, etc. to the developer in order to mask heavy metal ions. However, heavy metal chelates of nitrilotriacetic acid and ethylenediaminetetraacetic acid rather additionally accelerate the decomposition of hydroxylamine.

In addition, hydroxylamine is so harmful to the human body (P. G. Stecher, *The Merck Index-An Encyclopedia of Chemicals and Drugs*, 8th Ed. (1953)) that hydroxylamine and the water-soluble salt thereof are specified as weak poisons by Japanese law for managing poisons. Therefore, special care has to be exercised in handling color developers containing hydroxylamine in commercial photographic processings. In particular, such a developer is not suitable for amateur use at home.

Thus, it has been desired to develop an antioxidant replacing hydroxylamine.

2-Anilinoethanol and dihydroxyalkene are suggested in U.S. Pat. Nos. 3,823,017 and 3,615,503, respectively as an anti-oxidant for replacing hydroxylamine. However, both of these compounds are unstable themselves and do not have the effect of preventing color fog at all.

On the other hand, with respect to a developer (for black-and-white photography) containing hydroquinone or N-alkyl-p-aminophenol as a developing agent, saccharose (sucrose) is known as an antioxidant. However, saccharose is almost useless as an antioxidant for a color developer containing an aromatic primary amine as a developing agent.

Ascorbic acid and the derivatives thereof are known as antioxidants for a black-and-white developer and for a color developer. They possess, however, the defect of inhibiting coloration and causing a reduction in color density. Thus they are inferior to hydroxylamine for use in a color developer.

SUMMARY OF THE INVENTION

An object of the present invention is to provide a process for color photographic processing using a color developer stabilized against storage with a novel antioxidant.

Another object of the present invention is to provide a process for color photographic processing which does not cause color fog and/or color stain even when a color developer which has been stored is used.

A further object of the present invention is to provide a process for color photographic processing using a color developer containing a particular antioxidant which does not undergo accelerated decomposition even in the copresence of heavy metal ions such as iron ion or copper ion.

Still a further object of the present invention is to provide a process for color photographic processing using a color developer containing a harmless antioxidant.

Still a further object of the present invention is to provide a process for color photographic processing using a color developer containing an antioxidant which does not inhibit coloration.

It has now been found that these objects can be completely attained by adding at least one monosaccharide selected from the group consisting of a pentose, a methylpentose and a hexose to a color developer containing an aromatic primary amine.

DETAILED DESCRIPTION OF THE INVENTION

It is well known that saccharides include monosaccharides and polysaccharides, and that monosaccharides are generally represented by the general formula $C_nH_{2n}O_n$ wherein $n$ ranges from 3 to 10, preferably 5 to 6, which are classified into trioses ($n=3$), tetroses ($n=4$), pentoses ($n=5$), hexoses ($n=6$), heptoses ($n=7$), octoses ($n=8$), nonoses ($n=9$), decoses ($n=10$) and the like depending on the number of carbon atoms or oxygen atoms present. Special examples include methylpentoses of the formula $C_6H_{12}O_5$, and the like. In addition, these saccharides are also classified into ketoses and aldoses depending on the kind of reducing group present.

Saccharides which can be used in the present invention are pentoses, methylpentoses or hexoses. Examples of the pentoses are often found in nature and include D-xylose, L-arabinose, D-ribose, etc. and, as examples of the hexoses, are D-glucose, D-galactose, D-mannose, D-fructose, L-galactose and L-sorbose. Examples of methylpentoses include L-rhamnose, L-fucose, etc. Any of these saccharides can be used in the present invention. In addition, the optical isomers thereof can similarly be used. For simplicity of discussion, the pentoses, methylpentoses and hexoses which can be used in this invention will be collectively referred to as "monosaccharide".

Of these pentoses, hexoses and methylpentoses, the most effective ones are aldoses having a reductive aldehyde group. Particularly effective monosaccharides of this invention are aldopentoses such as D-xylose, D-ribose and D-arabinose.

In the present invention, these monosaccharides of the invention can be used in combination with an amino acid, in particular, an a-amino acid. Incorporation of an amino acid especially α-amino acid in the color developer of the present invention is preferred since it serves to reduce color fog even more.

Examples of amino acids which can be used include α-amino acids such as glycine, DL-α-alanine, DL-valine, DL-leucine, DL-isoleucine, DL-threonine, DL-methionine, DL-glutamic acid, DL-lysine, DL-arginine, DL-phenylalanine, DL-histidine, DL-proline, α-picolinic acid, etc. and β-alanine.

The monosaccharide of this invention can be suitably used in an amount ranging from about 0.1 g to about 100 g, preferably 0.5 to 50 g, particularly preferably 1 g to 20 g, per liter of the color developer.

In using α-amino acid in combination, the α-amino acid is used in an amount ranging from about 0.1 g to about 100 g preferably 0.5 g to 50 g, particularly preferably 1 g to 20 g, per liter of the color developer.

The pH of the color developer is in the range of from about 7 to about 14, preferably about 8 to 13. The temperature of the color developer is selected within the range of about 20° C. to about 70° C., preferably 30° C. to 60° C.

The color developer to be used in the present invention has the same composition as that of conventional color developers containing an aromatic primary amine developing agent except that such also contains the monosaccharide of this invention which is the characteristic aspect of the present invention. Preferred examples of aromatic primary amine color developing agents are p-phenylene-diamine derivatives as given below. That is, N,N-diethyl-p-phenylenediamine hydrochloride, 2-amino-5-diethylaminotoluene hydrochloride, 2-amino-5-(N-ethyl-N-laurylamino)toluene, 4-[N-ethyl-N-(β-hydroxyethyl)amino]aniline sulfate, 2-methyl-4-[N-ethyl-N-(β-hydroxyethyl)amino]aniline sulfate, N-ethyl-N-(β-methanesulfoamidoethyl)-3-methyl-4-aminoaniline sesquisulfate monohydrate described in U.S. Pat. No. 2,193,015, N-(2-amino-5-diethylaminophenylethyl)-methanesulfonamide sulfate described in U.S. Pat. No. 2,592,364, N,N-dimethyl-p-phenylenediamine hydrochloride, 4-amino-3-methyl-N-ethyl-N-methoxyethylaniline described in U.S. Pat. Nos. 3,656,950, 3,698,525, etc., 4-amino-3-methyl-N-ethyl-N-β-ethoxyethylaniline, 4-amino-3-methyl-N-ethyl-N-β-butoxyethylaniline, and the salts thereof (for example, sulfate, hydrochloride, sulfite, p-toluene-sulfonate, etc.), are preferred representative examples. A suitable amount of color developing agent can range from about 1 to about 20g/liter of the color developer, preferably from 1 to 10 g per liter of the color developer.

In addition, compounds known as conventional developer ingredients may be incorporated in the color developer. For example, an alkali agent and a buffer agent, such as sodium hydroxide, potassium hydroxide, sodium carbonate, potassium carbonate, sodium or potassium tertiary phosphate, potassium metaborate, borax, etc. can be used individually or in combination. A suitable amount of the alkali agent and the buffer agent can range from about 1 to about 50g per liter of the color developer.

Further, various salts such as disodium or dipotassium hydrogen phosphate, potassium or sodium dihydrogenphosphate, sodium or potassium bicarbonate, boric acid, an alkali metal nitrate, an alkali metal sulfate, and the like can be used for the purpose of imparting a buffer capability, for the convenience of preparation, or for increasing the ionic strength.

To the color developer may be added, if desired, optional development accelerators. For example, various pyridinium compounds and other cationic compounds represented by those described in U.S. Pat. No. 2,648,604, Japanese Patent Publication No. 9503/69 and U.S. Pat. No. 3,671,247, cationic dyes such as phenosafranine, neutral salts such as thallium nitrate or potassium nitrate, polyethylene glycol or the derivatives thereof as described in Japanese Patent Publication No. 9504/69, U.S. Pat. Nos. 2,533,990; 2,531,832; 2,950,970 and 2,577,127, nonionic compounds such as polythioethers, organic solvents and organic amines described in Japanese Patent Publication No. 9509/69 and Belgian Pat. No. 682,862, ethanolamine, ethylene diamine, diethanol amine, and accelerators described in L. F. A. Mason; *Photographic Processing Chemistry,* pp. 40–43 (Focal Press-London-1966) may be used. In addition, benzyl alcohol and phenylethyl alcohol described in U.S. Pat. No. 2,515,147, pyridine, ammonia, hydrazine, amines, etc. described in *Journal of Japanese Photographic Society,* vol. 14, p.74 (1952) are also useful development accelerators. A suitable amount of the development accelerator can range from about 0.01 to about 50 g per liter of the develper.

Furthermore, sodium sulfite, potassium sulfite, potassium bisulfite or sodium bisulfite, all of which are conventionally used as a preservative, may also be added. A suitable amount of these conventional preservatives can range from about 0.1 to about 10 g per liter of the color developers.

In the present invention, optional antifogging agents may be added, if desired, to the color developer, generally in an amount of about 0.001 to about 5 g per liter of the developer. Alkali metal halides such as potassium bromide, sodium bromide and potassium iodide, and organic antifogging agents may be used as the antifogging agent. Examples of organic antifogging agents, which can be used include nitrogen-containing hetero ring compounds such as benzotriazole, 6-nitrobenzimidazole, 5-nitroisoindazole, 5-methylbenzotriazole, 5-nitrobenzotriazole, 5-chlorobenzotriazole, etc., mercapto-substituted hetero ring compounds such as 1-phenyl-5-mercaptotetrazole, 2-mercaptobenzimidazole, 2-mercaptobenzothiazole, etc., and mercapto-substituted aromatic compounds such as thiosalicylic acid. Of these, nitrogen-containing hetero ring compounds are preferable, with nitrogen-containing hetero ring compounds which are not substituted with a mercapto group being particularly preferred. These compounds are used in an amount ranging from about 1 mg to 5 g, preferably 5 mg — 1 g, per liter of the color developer.

Furthermore, polyphosphoric acid compounds represented by sodium hexametaphosphate, sodium tetrapolyphosphate, sodium tripolyphosphate or the potassium salts of each of the above-described polyphosphoric acids, hydroxyalkanediphosphoric acids described in British Pat. No. 1,420,656, aminopolycarboxylic acids represented by ethylenediaminetetraacetic acid, nitrilotriacetic acid, cyclohexanediaminetetraacetic acid, iminodiacetic acid, N-hydroxymethylethylenediaminetriacetic acid, diethylene-triaminepentaacetic acid, etc. or combination thereof can be used as a water softener. They are usually used in an amount of about 0.5 to about 1 g/liter, although the amount varies depending upon the hardness of the water used to prepare the developer solution. Other calcium- or magnesium-ion sequestering agents may be used in the photographic processing solution. These are described in detail in J. Willems; *Belgische Chemische Industrie,* vol. 21, p.325 (1956) and ibid vol. 23, p. 1105 (1958).

In the case of reversal color processing, a competing coupler, a fogging agent and a compensating developer may also be added to the color developer.

Examples of useful competing couplers include citrazinic acid, J acid, H acid, etc. For example, those compounds which are described in U.S. Pat. No. 2,742,832, Japanese Patent Publication Nos. 9504/69, 9506/69, 9507/69, U.S. Pat. Nos. 3,520,690, 3,560,212, 3,645,737, etc. may be used.

Alkali metal borohydrides, amineboranes, ethylenediamine, etc. may be used as the fogging agent. In addition, compounds described in Japanese Patent Publication No. 38,816/72 are useful. A suitable amount of fogging agent can range from about 0.01 to about 20 g per liter of the developer.

p-Aminophenol, N-benzyl-p-aminophenol, 1-phenyl-3-pyrazolidone, etc. may be used as the compensating developer. For example, compounds described in Japanese Patent Publication Nos. 41,475/70 and 19,037/71 are useful. A suitable amount of the compensating developer can range from about 0.01 to about 5 g per liter of the developer.

The processing method of the present invention can be applied not only to color photographic processing wherein dye-forming couplers are incorporated in a light-sensitive material as described in, e.g., U.S. Pat. Nos. 2,322,027; 2,376,679 and 2,801,171 but also to color photographic processing wherein couplers are incorporated in a developer as described in, e.g., U.S. Pat. Nos. 2,252,718; 2,590,970 and 2,592,243.

At present, however, the former process is predominantly employed. Where dye-forming couplers are incorporated in a light-sensitive material, multi-layered light-sensitive materials are generally used. Therefore, it is desirable for the couplers to remain in a specific layer and not to diffuse into other layers during production, storage and processing.

The process of the present invention for processing color photographic materials can be applied to the diffusion transfer color photographic process using the process as described in U.S. Pat. Nos. 3,227,551 and 3,227,552. In this case, the couplers may diffuse into other layers during processing steps.

Thus, the processing method of the present invention is applicable to the processing of any conventional silver halide color photographic materials including color negative films, color papers, color positive films and color reversal films.

In the process of the present invention, the fundamental processing steps for imagewise-exposed color negative films, color positive films, color papers or the like are usually as follows.

(1) Color development → Bleaching → Washing → Fixing → Washing → Stabilizing → Drying (2) Color development → Bleach-fixing → Washing → Stabilizing → Drying (3) Color development → Stop-fixing → Bleach-fixing → Washing → Stabilizing → Drying In process (1) to (3), a pre-bath or a hardening bath may also be employed before color development, whereas a stabilizing bath or a washing after bleaching may be omitted.

On the other hand, the processing steps for imagewise exposed color reversal films usually involve the following fundamental steps.

(4) Black-and-white development → Stopping → Washing → Fogging → Washing → Color development → Bleaching → Washing → Fixing → Washing → Stabilizing → Drying (5) Black-and-white development → Stopping → Washing → Fogging → Washing → Color development → Bleach-fixing → Washing → Stabilizing → Drying In processes (4) and (5), a pre-bath, a prehardening bath, a neutralizing bath, etc. may be provided, whereas a stabilizing bath, a washing after bleaching, and the like may be omitted. A fogging bath may be replaced by a re-exposure to light or may be omitted by adding a fogging agent (e.g., t-butylamineborane, sodium borohydride, tin-aminopolycarboxylic acid complex salt, etc.) to the color developer.

In the photographic processing of the present invention, the above-described processes (1) through (5) are useful. However, the present invention is not limited to only these processes.

Typical processing procedures (including processing steps and color developer compositions) suitable for the present invention are shown below. The present invention, of course, is not to be construed as being limited to these.

| | | | |
|---|---|---|---|
| (i) | Procedure for Color Negative Processing: | | |
| | Processing Steps | | |
| | 1. Color Development | 3 min. and 15 sec. | |
| | 2. Bleaching | 6 min. and 30 sec. | |
| | 3. Washing | 3 min. and 15 sec. | |
| | 4. Fixing | 6 min. and 30 sec. | |
| | 5. Washing | 3 min. and 15 sec. | |
| | 6. Stabilizing | 3 min. and 15 sec. | |
| | Color Developer | | |
| | Sodium Nitrilotriacetate | 1.0 g | |
| | Sodium Sulfite | 4.0 g | |
| | Sodium Carbonate | 30.0 g | |
| | Potassium Bromide | 1.4 g | |
| | D-Xylose | 15 g | |
| | 4-(N-Ethyl-N-β-hydroxyethylamino)-2-methylaniline sulfate | 4.5 g | |
| | Water to make | 1 liter | |
| (ii) | Procedure for Color Reversal Processing | | |
| | Processing Steps | | |
| | First Development (black-and-white) | 30° C | 5 min. |
| | Stopping Solution | 30° C | 1 min. |
| | Washing | 30° C | 2 min. |
| | Color Development | 30° C | 7 min. |
| | Stopping Solution | 30° C | 2 min. |
| | Hardening Bath | 30° C | 2 min. |

-continued

| | | |
|---|---|---|
| Washing | 30° C | 2 min. |
| Bleaching Bath | 30° C | 4 min. |
| Washing | 30° C | 2 min. |
| Fixing Bath | 30° C | 4 min. |
| Washing | 30° C | 2 min. |
| Drying | 30° C | |
| Color Developer | | |
| Benzyl Alcohol | 5 ml | |
| Sodium Hydroxide | 0.5 g | |
| Diethylene Glycol | 3 ml | |
| Sodium Hexametaphosphate | 2 g | |
| Sodium Sulfite | 2 g | |
| Potassium Bromide | 2 g | |
| D-Xylose | 15 g | |
| 4-Amino-3-methyl-N-ethyl-N-(β-hydroxyethyl)aniline Sesquisulfate (monohydrate) | 5 g | |
| Citrazinic Acid | 0.4 g | |
| Metaboric Acid | 0.5 g | |
| Ethylenediamine (70% aqueous soln.) | 4 ml | |
| Nabox | 77 g | |
| Sodium Borohydride | 0.1 g | |
| Water to make | 1 liter | |
| (iii) Procedure for Processing Color Paper (Color intensification) | | |
| Processing Steps | | |
| Color Development | 40° C | 1 min. |
| Color Intensification | 40° C | 1 min. |
| Washing | 26° C | 30 sec. |
| Bleach-Fixing | 40° C | 1 min. |
| Washing | 26° C | 1 min. & 30 sec. |
| Color Developer | | |
| Benzyl Alcohol | 15 ml | |
| Potassium Carbonate | 30 g | |
| Potassium Bromide | 0.4 g | |
| D-Xylose | 15 g | |
| Potassium Sulfite | 4 g | |
| Diaminopropanoltetraacetic Acid | 3 g | |
| N-Ethyl-N-methoxyethyl-3-methyl-p-phenylenediamine Di-p-toluene sulfonate | 7.5 g | |
| Water to make | 1 liter (pH 10.1) | |

Color intensification as used herein means the process of using hydrogen peroxide or the like as described in, e.g., West German Patent Application (OLS) Nos. 1,813,920; 1,950,102; 1,995,901; 1,961,029; 2,044,833; 2,044,993; 2,056,360; 2,056,359 and 2,120,091. The composition of a typical intensifier is, for example, as follows.

| Intensifier | |
|---|---|
| Hydrogen Peroxide (30% aq. soln.) | 30 ml |
| Sodium Secondary Phosphate (dodecahydrate) | 36 g |
| Sodium Pyrophosphate (heptahydrate) | 1 g |
| Sodium Stannate | 0.1 g |
| 6-Nitrobenzimidazole | 0.3 g |
| Water to make | 1 liter (pH 9.0) |

The color developer in accordance with the present invention can be employed, in absolutely the same manner, with color intensification using a Co(III) complex as described in U.S. Pat. Nos. 3,826,652; 3,834,907; 3,748,138 and 3,765,819.

In the photographic processing method of the present invention, known couplers may optionally be used as couplers for forming dye images. Couplers are in some cases incorporated in a color developer but, recently, they are generally incorporated in a photographic light-sensitive material. In many cases, couplers desirably possess such structure that they remain in a particular layer and do not diffuse into other layers during production, storage of the light-sensitive materials and processing. The couplers can be either of the 4-equivalent type and the 2-equivalent type. In addition, colored couplers for color correction, couplers which do not form color or couplers capable of releasing a development inhibitor upon development (so-called DIR couplers) can be used.

Known open-chain ketomethylene couplers may be used as a yellow color-forming coupler. Of these, benzoylacetanilide series and pivaloylacetanilide series couplers are advantageous. Specific examples of suitable yellow color-forming couplers include those described in U.S. Pat. Nos. 2,875,057; 3,265,506; 3,408,194; 3,551,155; 3,582,322; 3,725,072; 3,894,875; West German Patent Publication No. 1,547,868, West German Patent Application (OLS) Nos. 2,213,461; 2,219,917; 2,261,361; 2,263,875; 2,414,006; etc.

5-Pyrazolone compounds are predominantly used as a magenta coupler. Indazolone compounds and cyanoacetyl compounds are also suitable. Examples of magenta couplers are those described in U.S. Pat. Nos. 2,600,788; 2,983,608; 3,062,653; 3,127,269; 3,311,476; 3,419,391; 3,476,560; 3,519,429; 3,558,319; 3,582,322; 3,615,506; West German Pat. No. 1,810,464; West German Patent Application (OLS) Nos. 2,408,665; 2,418,959; 2,424,467; Japanese Patent Publication Nos. 6031/65, 2016/69, etc.

Phenol or naphthol derivatives are mainly used as a cyan coupler. Specific examples of phenol or naphthol couplers are those described in U.S. Pat. Nos. 2,369,929; 2,434,272; 2,474,293; 2,521,908; 2,895,826; 3,034,892; 3,311,476; 3,386,830; 3,458,315; 3,476,563; 3,583,971; 3,591,383; Japanese Patent Application (OPI) No. 78,905/73, etc.

In addition, couplers capable of releasing a development inhibitor upon coupling reaction (so-called DIR couplers) or compounds capable of releasing a development-inhibiting compound may be employed. Examples of these compounds are described in U.S. Pat. Nos. 3,227,554; 3,617,291; 3,632,345; 3,701,783; 3,790,384; British Pat. No. 953,454; West German Patent Application (OLS) Nos. 2,414,006; 2,417,914; 2,417,945; 2,454,301; 2,454,329; U.S. Pat. Nos. 3,297,445; 3,379,529; etc.

In addition, those couplers which are described in Japanese Patent Application Nos. 37,651/74; 99,617/74; 66,378/74; 92,685/74; 98,469/74; 114,445/74; 1,792/75; 70,592/75; 96,435/75; 118,029/75; 118,540/75; etc. may also be used.

A suitable amount of coupler in the developer can range from about 0.1 to 10 g per liter of the developer.

The above-described couplers and the like may be added as a combination of two or more in the same layer in order to satisfy the characteristics required for light-sensitive materials, and it is, or course, possible to add the same compound to two or more different layers.

These couplers are generally dispersed in a silver halide photographic emulsion layer together with a solvent having a suitable polarity. Useful solvents include tri-o-cresyl phosphate, trihexyl phosphate, dioctylbutyl phosphate, di-butyl phthalate, diethyllaurylamide, 2,4-diallylphenol, octyl benzoate, etc.

Color light-sensitive materials to be processed according to the process of the present invention generally have, on a support, at least one silver halide emulsion layer, usually a red-sensitive silver halide emulsion layer, a green-sensitive silver halide emulsion layer and a blue-sensitive silver halide emulsion layer. Ordinarily, they have, on a support, at least one red-sensitive silver halide emulsion layer containing a cyan dye image-forming coupler, at least one green-sensitive silver halide emulsion layer containing a magenta image-forming coupler, and at least one blue-sensitive silver halide emulsion layer containing a yellow dye image-forming coupler. Such elements may contain light-insensitive photographic layers (e.g., an antihalation layer, an intermediate layer for preventing color mixing or the like, a yellow filter layer, protective layer, etc.). In addition, the order of arrangement of the red-sensitive layer, the green-sensitive layer and the blue-sensitive layer is not limited in any way.

Color light-sensitive materials to be processed according to the process of the present invention may contain, as a silver halide, any of silver bromide, silver chloride, silver chlorobromide, silver bromoiodide and silver chlorobromoiodide in a photographic emulsion layer. When two or more photographic emulsion layers are provided, two or more of these silver halides may be used in combination. Photographic emulsions can be prepared using known processes such as that described in P. Grafkides; *Chimie Photographique* Paul Montel, Paris (1967), and any of an ammoniacal process, a neutral process, an acidic process, a single jet process, a reverse mixing process, a double jet process, a controlled double jet process, and the like can be used.

The crystal form of these silver halide grains may be in any of a cubic form, an octahedral form and a mixture thereof. As to the crystal structure of the silver halide grains, those which have a uniform structure to the core, those which have a layered structure wherein the inner part and the outer part differ from each other, and the so-called conversion-type grains as described in British Pat. No. 635,841 and U.S. Pat. No. 3,622,318 may be used. In addition, either of the type of grains which form latent images mainly on the surface of the grains and internal latent image type which form latent images inside the grains may be used.

The silver halide emulsion can be chemically sensitized through known processes. For this purpose, for example, sulfur compounds as described in U.S. Pat. No. 1,574,944; gold compounds as described in U.S. Pat. No. 2,399,083, etc.; compounds of noble metals such as platinum, palladium, iridium, rhodium, ruthenium, etc. as described in U.S. Pat. Nos. 2,448,060; 2,598,079 and British Pat. No. 618,061; reducing materials such as stannous salts, amines, etc. can be used.

Gelatin is usually used as a hydrophilic colloid in the silver halide emulsion layer and the other layers of the light-sensitive material to be processed according to the present invention.

Other hydrophilic colloids than gelatin can also be used. For example, gelatin derivatives; graft polymers of gelatin with other high polymers; cellulose derivatives such as hydroxyethyl cellulose, carboxymethyl cellulose, cellulose sulfate, etc.; saccharide derivatives such as sodium alginate, starch derivatives, etc.; various synthetic high polymers such as homopolymers or copolymers of polyvinyl alcohol, partially acetallized polyvinyl alcohol, poly-N-vinylpyrrolidone, polyacrylic acid, polymethacrylic acid, polyacrylamide, polyvinylimidazole, polyvinylpyrazole, etc. can be used.

As gelatin, lime-processed gelatin is useful. In addition, acid-processed gelatin derivatives can also be used, for example, a reaction product between gelatin and an acid halide, an acid anhydride or an isocyanate.

The light-sensitive material may further contain a hardener such as those described in U.S. Pat. No. 3,325,287; a plasticizer such as the compounds described in U.S. Pat. No. 3,775,128 or glycerin, a surface active agent such as an alkylbenzenesulfonic acid, an alkylene oxide condensate, the compounds described in U.S. Pat. Nos. 2,739,891 and 3,415,649, and additives for improving the photographic properties, image properties and mechanical properties of light-sensitive materials.

The light-sensitive material to be processed according to the present invention may contain, as a color fog-preventing agent, a hydroquinone derivative, an aminophenol derivative, a gallic acid derivative, an ascorbic acid derivative, etc. Specific examples thereof are described in U.S. Pat. Nos. 2,360,290; 2,336,327; 2,403,721; 2,418,613; 2,675,314; 2,701,197; 2,704,713; 2,728,659; 2,732,300; 2,735,765; Japanese Patent Application (OPI) Nos. 92,988/75; 92,989/75; 93,928/75; 110,337/75; Japanese Patent Publication No. 23,813/75, etc.

The light-sensitive material to be processed according to the present invention may contain, in a hydrophilic layer, thereof, an ultraviolet ray-absorbing agent. For example, aryl group-substituted benzotriazole compounds (e.g., those described in U.S. Pat. No. 3,533,794), 4-thiazolidone compounds (e.g., those described in U.S. Pat. Nos. 3,314,794; 3,352,681), benzophenone compounds (e.g., those described in Japanese Patent Application (OPI) No. 2,784/71), cinnamic acid esters (e.g., those described in U.S. Pat. Nos. 3,705,805; 3,707,375), or benzoxazole compounds (e.g., those described in U.S. Pat. No. 3,499,762) can be used. Ultraviolet light-absorbing couplers (e.g., cyan dye-forming couplers of $\alpha$-naphthols) or ultraviolet light absorbing polymers may be used as well. These ultraviolet light-absorbing agents may be mordanted to a particular layer.

In the hydrophilic colloidal layer of the light-sensitive material to be processed according to the present invention may be incorporated brightening agents of the stilbene series, the triazine series, the oxazole series or the coumarin series. These may be water-soluble, or it is also possible to use water-insoluble brightening agents in the form of a dispersion. Specific examples of fluorescent brightening agents are described in U.S. Pat. Nos. 2,632,701; 3,269,840; 3,359,102; British Pat. No. 1,319,763, etc.

Exposure of the light-sensitive material for obtaining photographic images can be conducted in a conventional manner. That is, any of various known light sources such as natural light (sunlight), a tungsten lamp, a fluorescent lamp, a mercury lamp, a xenon arc lamp, a carbon arc lamp, a xenon flash lamp, a cathode ray tube flying spot and the like may be used. Suitable exposure times include the range employed in general for ordinary cameras (1/1000–1 sec) and, in addition, exposure times of shorter than 1/1000, for example $1/10^4$–$1/10^6$ sec using a xenon flash lamp or a cathode ray tube, and exposure times of longer than 1 sec can be employed as well. The spectral composition of the exposure light may be adjusted, if necessary, by using a color filter. Laser light may also be used for exposure. In addition, the photographic material may be exposed to light emitted from a fluorescent material excited by electron beams, X rays, gamma rays, $\alpha$-rays, or the like.

The process of the present invention is superior to conventional processes in the following points. Firstly, the stability of the color developer containing an aromatic primary amine developing agent is quite excellent even in the presence of heavy metal ions such as iron or copper ion, and no color fog or color mixing takes place even when a color developer which has been stored or heated is used.

Secondly, the color developer is free from danger in handling, since it does not contain toxic materials such as hydroxylamine.

Thirdly, the color developer does not inhibit coloration which is different from the developer using ascorbic acid or high concentrations of sulfite as an antioxidant. In addition, the mono saccharides to be used in the present invention are inexpensive.

The present invention will now be illustrated in more detail by the following preferable embodiments of the present invention which, however, do not limit the embodiments of the present invention in any way. Unless otherwise indicated herein, are parts, percents, ratios, and the like are by weight.

EXAMPLE 1

On a polyethylene-coated paper support were coated a blue-sensitive silver bromide emulsion layer containing a yellow coupler emulsion dispersion, a green-sensitive silver chlorobromide emulsion (AgCl: 70 mole %) layer containing a magenta coupler emulsion dispersion, a red-sensitive silver chlorobromide emulsion (AgCl: 70 mole %) layer containing a cyan coupler emulsion dispersion, and a gelatin layer containing an ultraviolet light-absorbing agent to prepare a color paper. Each coupler emulsion used in this color paper was prepared by dissolving each coupler in a mixture of dibutyl phthalate and tricresyl phosphate, and dispersing in a gelatin solution as an O/W type emulsion using sorbitan monolaurate and sodium dodecylbenzenesulfonate as dispersing and emulsifying agents.

As the couplers, α-(2,4-dioxo-5,5'-dimethyloxazolidinyl)-α-pivaloyl-2-chloro-5-[α-(2,4-di-t-amylphenoxy)-butyramido]-acetanilide, 1-(2,4,6-trichlorophenyl)-3-[(2-chloro-5-tetradecanamido)-anilino]-2-pyrazolon-5-one, and 2-[α-(2,4-di-t-amylphenoxy)-butanamido]-4,6-dichloro-5-methylphenol were respectively used. As the ultraviolet ray absorbing agent, compound (a) having the following structural formula was used.

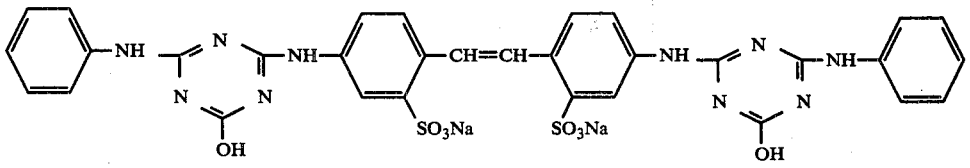

In the emulsion, 6-methyl-4-hydroxy-1,3,3a,7-tetrazaindene was used as an antifogging agent.

The coated amounts of the couplers and silver salts were as follows.

| Layer | Amount of Coated Coupler ($g/m^2$) | Amount of Coated Silver Salt ($Ag \cdot g/m^2$) |
|---|---|---|
| Red-sensitive Layer | 0.4 | 0.5 |
| Green-sensitive Layer | 0.5 | 0.6 |
| Blue-sensitive Layer | 0.4 | 0.8 |

This photographic element was exposed (1 sec, 500 C.M.S.) using a sensitometer, then subjected to the following processings.

| | | |
|---|---|---|
| Processing Steps: | | |
| Color Development | 31° C | 3 min. & 30 sec. |
| Bleach-fixing | " | 1 min. & 30 sec. |
| Washing | " | 2 min. |
| Stabilizing | " | 1 min. |
| Color Developer Composition | | |
| Benzyl Alcohol | | 14 ml |
| Sodium Sulfite | | 2 g |
| Potassium Bromide | | 0.5 g |
| Sodium Carbonate (monohydrate) | | 30 g |
| 4-Amino-N-ethyl-N-(β-methanesulfonamido)-m-toluidine Sesquisulfate (monohydrate) | | 5 g |
| Added Compound (See Table 1 below) | | |
| Water to make | | 1 liter |
| Bleach-fixing Solution | | |
| Ammonium Thiosulfate (70% aqueous solution) | | 150 ml |
| Sodium Sulfite | | 5 g |
| Na[Fe(EDTA)] | | 40 g |
| EDTA | | 4 g |
| Water to make | | 1 liter |
| (EDTA stands for ethylenediaminetetraacetic acid.) | | |
| Stabilizing Solution | | |
| Acetic Acid (glacial) | | 10 ml |
| Sodium Acetate | | 5 g |
| Formaldehyde (37% aqueous solution) | | 5 ml |
| Water to make | | 1 liter |

The color developer was left, after preparation, for 7 days at 31° C. to study the photographic properties and the amount of remaining developing agent. The results obtained are shown in Table 1.

Table 1

| Run No. | Added Compound | Added Amount (mol/l) | Amount of Remaining Developing Agent (g/l) | Color Fog Density Y | M | C | Note |
|---|---|---|---|---|---|---|---|
| 1 | None | — | 1.94 | 0.12 | 0.08 | 0.06 | comparison |
| 2 | Hydroxylamine Sulfate | 0.05 | 3.50 | 0.11 | 0.04 | 0.03 | " |
| 3 | D-Xylose | " | 3.45 | 0.09 | 0.03 | 0.03 | present invention |
| 4 | D-Ribose | " | 3.51 | 0.09 | 0.03 | 0.03 | " |
| 5 | L-Arabinose | " | 3.17 | 0.10 | 0.03 | 0.03 | " |
| 6 | D-Fructose | " | 3.05 | 0.10 | 0.03 | 0.04 | " |
| 7 | Dihydroxyacetone | " | 3.30 | 0.11 | 0.08 | 0.05 | comparison |
| 8 | 2-Anilinoethanol | " | 2.01 | 0.11 | 0.07 | 0.05 | " |

(*Y,M and C represent yellow, magenta and cyan color, respectively.)

In Table 1, Run Nos. 1, 2, 7 and 8 are for comparison, whereas Run Nos. 3–6 correspond to the present invention.

As is clear from the results in Table 1, the developers of the present invention containing D-xylose, D-ribose, D-arabinose or D-fructose have almost the same ability of preventing oxidation of the developing agent as that of hydroxylamine and, as to the effect of preventing color fog after storage, the monosaccharide compounds are slightly better than hydroxylamine. Monosaccharides in accordance with the present invention do not have the toxicity hydroxylamine exhibits, and yet have the excellent capability as an antioxidant as described above. 2-Anilinoethanol used in Run No. 8 is a compound described in U.S. Pat. No. 3,823,017. However, it shows extremely poor effect as an antioxidant. Dihydroxyacetone used in Run No. 7 is a compound described in U.S. Pat. No. 3,615,503. However, it shows an extremely poor effect in preventing color fog as is the case with 2-anilinoethanol. (Comparison of color fog density in Run Nos. 7 and 8 with that in Run No. 1 clearly shows this to be the case.) Mono saccharides of the present invention are particularly excellent in preventing magenta color fog as compared with these two compounds.

EXAMPLE 2

This Example demonstrates that addition of an amino acid to the color developer of the present invention is even more advantageous. The procedures were conducted in the same manner as in Example 1. The results obtained are shown in Table 2.

Table 2

| Run No. | Added Compound | Added Amount (mol/l) | Amount of Remaining Developing Agent (g/l) | Color Fog Density Y | M | C |
|---|---|---|---|---|---|---|
| 21 | None (for comparison) | — | 2.01 | 0.11 | 0.08 | 0.06 |
| 22 | Hydroxylamine Sulfate (") | 0.050 | 3.47 | 0.10 | 0.04 | 0.04 |
| 23 | D-Xylose (") | 0.050 | 3.44 | 0.10 | 0.03 | 0.04 |
| 24 | Glycine (") | 0.050 | 2.12 | 0.11 | 0.07 | 0.05 |
| 25 | D-Xylose | 0.050 | | | | |
| | | | 3.41 | 0.07 | 0.01 | 0.01 |
| | Glycine | 0.050 | | | | |
| 26 | L-Arabinose (") | 0.050 | 3.30 | 0.10 | 0.04 | 0.04 |
| 27 | L-Arabinose | 0.050 | | | | |
| | | | 3.32 | 0.08 | 0.01 | 0.03 |
| | Glycine | 0.050 | | | | |

(Y, M and C stand for color fog of yellow, magenta and cyan, respectively.)

From the above-described results, it can be seen that combined use of the mono saccharide and the amino acid further prevents fog after storage.

EXAMPLE 3

This Example shows the effect of the present invention in the presence of iron ion in the color developer. To each of the color developers used in Example 1 was added iron (III) ion in an amount of 0.5 ppm as elemental iron and, after storage for 7 days at 31° C. as in Example 1, the photographic properties were compared. The results thus obtained are shown in Table 3. (In Table 3, Y, M and C represent yellow, magenta and cyan density, respectively.)

Table 3

| Run No. | Added Compound | Added Amount (mol/l) | Color Fog Density Y | M | C | M Component* in Y color image (density) |
|---|---|---|---|---|---|---|
| 31 | — | — | 0.11 | 0.08 | 0.06 | 0.18 |
| 32 | Hydroxylamine Sulfate | 0.05 | 0.12 | 0.06 | 0.04 | 0.25 |
| 33 | D-Xylose | 0.05 | 0.10 | 0.03 | 0.03 | 0.15 |

*Showing values at the area where Y density of yellow image is 2.0.
Note: All developers contained 0.5 ppm $Fe^{+++}$.

As compared with the case of using hydroxylamine as a known antioxidant, the process of the present invention exhibits, in the presence of iron ion, a greater effect of preventing color fog when the color developer is used after storage. This difference is marked with respect to magenta color fog. The color developer containing hydroxylamine deteriorates, when stored, the purity of the color image, in particular the yellow color image, in the presence of iron ion.

While the invention has been described in detail and with reference to specific embodiments thereof, it will be apparent to one skilled in the art that various changes and modifications can be made therein without departing from the spirit and scope thereof.

What is claimed is:

1. A process for processing color photographic materials, which involves color development processing an image-wise exposed silver halide color light-sensitive material with a color developer, in which the color developer contains a p-phenylenediamine color developing agent and at least one monosaccharide selected from the group consisting of D-xylose, D-ribose and D-arabinose as an antioxidant.

2. The process of claim 1, wherein said color developer additionally contain an amino acid.

3. The process of claim 2, wherein said amino acid is an α-amino acid.

4. The process of claim 2, wherein said amino acid is glycine, DL-α-alanine, DL-valine, DL-leucine, DL-isoleucine, DL-threonine, DL-methionine, DL-glutamic acid, DL-lysine, DL-arginine, DL-phenylalanine, DL-histidine, DL-proline, α-picolinic acid or β-alanine.

5. The process of claim 1, wherein said monosaccharide is present in an amount ranging from about 0.1 g to about 100 g per liter of said color developer.

6. The process of claim 2, wherein said amino acid is present in an amount of about 0.1 g to about 100 g per liter of said color developer.

7. A process for processing color photographic materials, which involves color development processing an image-wise exposed silver halide color light-sensitive material with a color developer, in which the color developer contains a p-phenylenediamine color developing agent and L-arabinose as an antioxidant.

* * * * *